United States Patent [19]

Townsend, Jr. et al.

[11] 3,945,795

[45] Mar. 23, 1976

[54] MEANS FOR PREVENTING DAMAGE TO JACKETED FLEXIBLE PUMPING STRAND

[75] Inventors: Herbert E. Townsend, Jr., Coopersburg; James B. Horton, Bethlehem, both of Pa.

[73] Assignee: Bethlehem Steel Corporation, Bethlehem, Pa.

[22] Filed: Apr. 3, 1974

[21] Appl. No.: 457,526

[52] U.S. Cl. ..... 21/61; 21/2; 21/2.5 R; 21/2.7 R; 137/539; 138/109; 138/178; 166/243; 403/31; 403/37

[51] Int. Cl.[2] B05C 5/00; C23F 11/00; E21B 17/04; E21B 43/00

[58] Field of Search ..... 21/2.5 R, 2.7 R, 61; 166/243, 304, 57; 138/103, 109, 178; 403/31, 34, 37; 137/539

[56] References Cited

UNITED STATES PATENTS

| | | | |
|---|---|---|---|
| 1,570,828 | 1/1926 | Fisher | 137/539 X |
| 2,658,939 | 11/1953 | Greenfield et al. | 174/24 |
| 3,219,373 | 11/1965 | Sutliff | 403/34 |
| 3,263,520 | 8/1966 | Tschanz | 138/109 X |
| 3,301,277 | 1/1967 | Kelley | 166/75 X |
| 3,637,341 | 1/1972 | Horton et al. | 21/2.7 R X |

*Primary Examiner*—Barry S. Richman
*Assistant Examiner*—Bradley R. Garris
*Attorney, Agent, or Firm*—Joseph J. O'Keefe; Charles A. Wilkinson

[57] ABSTRACT

Damage due to rupture or ballooning of the plastic jacket on a flexible pumping strand due to filling of the well with gas is prevented by providing an assembly including a preset pressure release valve in the lower portions of the strand to quickly release fluid from the interior of the strand to the surrounding environment upon the attainment of a pressure differential between the interior and exterior of the strand within a predetermined fraction of the rupture or ballooning strength of the plastic jacket on the pumping strand.

6 Claims, 2 Drawing Figures

MEANS FOR PREVENTING DAMAGE TO JACKETED FLEXIBLE PUMPING STRAND

BACKGROUND OF THE INVENTION

This invention relates to oil well pumping and especially to pumping with flexible pumping strand and more particularly to flexible pumping strand assemblies equipped with safety devices designed to prevent ballooning and rupture of the strand due to events or accidents which may produce excess pressure in the strand.

U.S. Pat. No. 3,637,341 issued Jan. 25, 1972 to Horton et. al. and assigned to the assignee of the present invention discloses a corrosion protection system for flexible pumping strand used in oil wells. In accordance with the invention disclosed in said patent a flexible pumping strand is provided with a flexible outer jacket customarily formed of a plastic resin composition, which jacket isolates the wires of the strand from the surrounding environment and also encloses a corrosion inhibiting fluid within the strand. In accordance with the preferred operation of this prior invention to corrosion inhibiting fluid is passed slowly through the strand either continuously or intermittently so that the inhibitor is continuously or periodically renewed in order to overcome the inhibitor exhausting effects of any corrosive substances which may gain access to the interior of the pumping strand through the strand jacket. Such corrosion including substances may gain access to the interior of the strand either through a slight permeability of the jacket over long periods of time or through defects in the jacket. In accordance with the prior invention the corrosion inhibiting fluid is selected or adjusted to have a specific gravity substantially similar to the specific gravity of the liquid components or major liquid components of the surrounding environment in the oil well so that the pressure due to the head of corrosion inhibiting liquid in the interior of a long length of strand extending down an oil well will be similar to the pressure in the oil well outside of the flexible pumping strand. If the pressure differential between the interior of the strand and the surrounding environment on the exterior of the strand is greater than the ballooning or yield strength of the plastic of the strand jacket the jacket will balloon and eventually rupture usually at the location of the greatest pressure differential, particularly if the exterior pressure is less than the interior pressure. If the location of the pressure differential is at the bottom of the strand due to the use of too dense a corrosion inhibiting liquid the ballooning of the jacket will occur near the bottom of the well or the lower end of the strand, while if the corrosion inhibiting liquid is not dense or heavy enough it will have to be forcibly pumped to the lower portions of the strand and the force of the pump may cause ballooning or rupture of the strand jacket near the top of the well or in the upper portions of the flexible pumping strand.

It has been discovered that while the provision of a corrosion inhibiting liquid in the interior of a flexible pumping strand having a specific gravity similar to the specific gravity of the surrounding environment in accordance with the previous invention is effective to prevent ballooning, rupture or other damage to the jacket of the strand during normal operation or use of the strand to operate a down-hole pumping apparatus, difficulty with ballooning and rupture of the strand jacket may still occur if for some reason the well tubing becomes suddenly or even in some cases slowly filled with gas so that the density and weight of the environment at the exterior of the strand becomes much less than the density or weight of the corrosion inhibiting liquid in the interior of the flexible pumping strand. In such case if ballooning and rupture of the strand jacket is to be avoided the pressure of the liquid in the interior of the strand must be relieved before the ballooning strength of the plastic jacket is exceeded by the pressure differential between the interior and the exterior of the strand.

Loss of exterior pressure in an oil well may occur in a number of manners of which the following are notable examples.

a. The pumping apparatus at the bottom of the well may fail so that oil is no longer being pumped. Normally this will involve in the usual type of pump the failure of both the lower ball valves to close. If the valves fail to close properly the oil in the well tubing will drain out through the pump and be replaced with gas or vapor either from the well or from the atmosphere.

b. The well tubing may develop a hole or a series of perforations through which the oil in the tubing may drain. Holes or openings in the tubing may originate as a result of corrosion or abrasion through the tubing, physical puncture of the tubing or because the tubing unscrews at a coupling. Accidental unscrewing of tubing couplings is by no means uncommon in many oil wells.

c. The oil well pump may unseat from its seating arrangement in the tubing at the bottom of the well. Such unseating of the pump may often occur due to binding of the plunger rod against the packing in the pump. Binding of the plunger may be due to loose scale or sand getting in the packing of the pump or to corrosion of the pumping rod, dropping of objects into the well and the like. If the plunger rod binds in the packing the entire pump may be lifted during the upstroke of the pump and the pump unseated in the well tubing, whereupon the oil in the tubing will drain from the tubing. Very often when the pump fails due to various types of breakage or the like the pump body will also become unseated within the well tubing allowing the oil to drain from the tubing.

d. A bubble or pocket of gas from the surrounding strata may gain access to the well and expel all the oil within the tubing leaving only a light gas. This eventuality is liable to occur in wells which do not have enough gas pressure to cause the oil to flow from the well by gas pressure alone without pumping, but do have some residual gas pressure in the surrounding strata. Sometimes the entrance of gas into the well is very sudden causing a very rapid change in pressure in the well.

All of the foregoing eventualities which result in the substitution of a gaseous medium for a liquid medium in the well, usually unexpectedly and quite often very rapidly, may cause a significant pressure differential between the interior of the pumping strand and the exterior environment which, if the flexible pumping strand is of any great length, will often quickly exceed the ballooning or rupture strength of the plastic jacket of the pumping strand. Exceeding the ballooning strength of the plastic jacket quickly results in ballooning of the jacket which, if continued quickly leads to rupture of the strand jacket allowing access of the corrosive exterior environment to the metal wires of the interior of the strand with resultant corrosion and also allowing the corrosion inhibitor in the interior of the strand to escape with the same ultimate effect. Even if the rupture strength of the strand jacket is not exceeded and the jacket only balloons, the jacket will be weakened and its thickness decreased and it may be exposed to physical damage during operation or removal from the well. Some plastic materials, furthermore, may exhibit rupture under excess pressure without initial ballooning and other plastics may exhibit either ballooning and then rupture or rupture without initial ballooning depending upon the environment or conditions. The foregoing list of eventualities which may result in the loss of oil from the well tubing is exemplary only and it will be understood that it is neither exhaustive nor exclusive.

SUMMARY OF THE INVENTION

It has been discovered that the foregoing difficulties and problems associated with differential pressures between the interior and the exterior of a linear member such as a flexible pumping strand filled with a corrosion inhibiting liquid when the well tubing in which the strand is located becomes filled with gas can be avoided by providing a flexible pumping strand assembly including a preset pressure exhaust valve near the bottom of the pumping strand. The preset pressure valve is set to open when a pressure differential between the exterior and interior of the strand is exceeded which is between the normal operating pressure differential and the ballooning or rupture pressure differential of the strand jacket. When this pressure differential is exceeded the valve will open and the corrosion inhibiting fluid in the interior of the strand will be rapidly dumped or drained from the strand before the ballooning pressure, i.e., the pressure differential at which ballooning of the plastic jacket may occur, or the rupture pressure, i.e., the pressure differential at which rupture of the plastic jacket may occur, is exceeded.

DESCRIPTION OF THE PREFERRED EMBODIMENT

Figure 1:
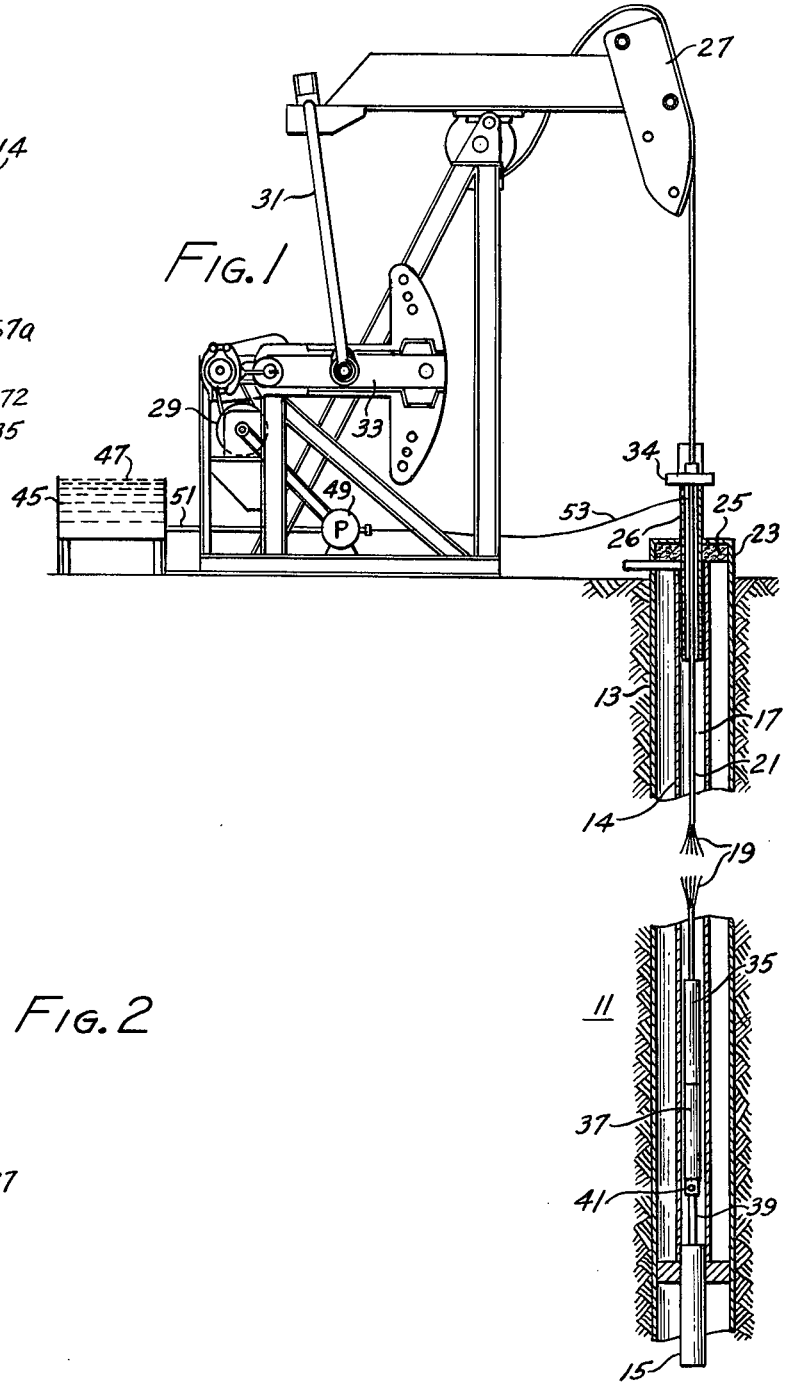
FIG. 1 is a general elevation of a flexible pumping strand assembly in an oil well according to the present invention.

In FIG. 1 there is shown a schematic view of an oil well 11 including a well casing 13, a differential pressure or other suitable pump (i.e. down-hole pumping means) 15 positioned at the bottom of the well 11 and seated in the end of tubing 14 to pump the oil up to the surface through the tubing 14, which extends from the pump to the surface to conduct the oil to the surface, and a flexible pumping strand 17 comprised of individual steel wires 19 and a nylon plastic jacket 21 covering the surface of the strand which strand extends through the well tubing 14 from the surface to the pump 15 or equipment attached ultimately to the pump. The flexible pumping strand 17 passes at the well head 23 through the usual packing 25 preferably being protected at this point by a so-called hollow polished rod 26 which is secured to the strand and reciprocates in the packing 25 as the flexible pumping strand 17 is reciprocated by movements of a horsehead 17 (i.e. secondary prime mover means) operated at the surface by motor 29 (i.e. primary prime mover means) through connecting rod 31 connected to flywheel arm 33. The reciprocation of flexible pumping strand 17 serves to operate pump 15 to which the flexible pumping strand is attached through a swagged fitting 35, a pressure release valve 37, and a pony or pump rod 39. A conventional shear release means 41 is preferably used to connect the pony rod 39 to the pressure release valve 37, but could be positioned at some other location or even omitted.

The well shown in FIG. 1 may be several thousand feed deep and will normally contain crude oil and in many instances highly corrosive salts and gaseous substance.

At the surface adjacent to horsehead 27 and motor 29 is a reservoir 45 of a suitable corrosion inhibitor 47. This inhibitor may be composed of a liquid with various additives such as are suggested in U.S. Pat. No. 3,637,341 as corrosion inhibiting additions or with other inhibiting substances. A pump 49 located adjacent to reservoir 45 and connected by pipe 51 with the reservoir is operated by a belt connection to motor 29, which motor functions in the first instance primarily to operate horsehead 27. In the alternative, pump 49 may be operated by suitable connections to horsehead 27 or by an independent motor. Pump 49 serves to introduce corrosion-inhibiting liquid 47 from reservoir 45 into flexible pumping strand 17 through tubing 53 connected to flexible pumping strand 17 at any suitable location such as, for instance, above well head 23 and below carrier bar 34 as shown in FIG. 1 and forced with slight positive pressure towards the termination of strand 17 at or near the pump 15 at the bottom of well 11. The corrosion inhibitor 47 could also be introduced into the extreme upper end of the flexible pumping strand 17. As an alternative to the use of the pump 49 the reservoir 45 might be a pressurized reservoir adapted to receive and contain a pressurized gas over the surface of the reservoir which accumulated gas serves to apply a permanent pressure to the surface of the liquid, which pressure is transferred to the liquid in the flexible pumping strand and serves to force the corrosion inhibiting liquid into the pumping strand. The corrosion inhibiting liquid may be introduced into the strand by whatever pumping apparatus is provided either continuously or intermittently, or, in certain instances, the corrosion inhibiting liquid, if not much corrosive action is encountered in the particular well, may merely be pressurized in the pumping strand in a static condition either permanently or for long periods.

It is essential in a practical deep corrosion retardant system that the specific gravity of the corrosion inhibiting liquid be substantially the same as or at least not differ greatly from that of the surrounding fluid medium in the well. The corrosion inhibiting liquid will in any event be selected so that the differential density of the corrosion inhibitor with respect to the environment will avoid ballooning, rupture or other damage to the plastic jacket for the length of strand involved. The density difference between the corrosion inhibitor and the surrounding medium may be allowably greater for short strands than for long strands. The range of specific gravities for most liquids will range from 0.8, the specific gravity of ethyl alcohol, to 1.4, the specific gravity of a 40 percent calcium chloride solution and the specific gravities of the corrosion inhibitor liquid may also be within or just outside this range, particularly for the lower densities, depending upon the environment in which it is to be used and the vertical length of the flexible pumping strand.

Since the flexible pumping strand is filled with a corrosion inhibiting fluid having a specific gravity within or close to the range of specific gravities of 0.8 to 1.4 it will be seen that if the pumping strand is fairly long and the external liquid contents of the well is suddenly replaced by a gaseous medium the entire head of corrosion inhibiting liquid in the strand will be applied to the liquid in the bottom of the strand generating a considerable internal pressure in the strand which internal pressure will then be exerted against the essentially unsupported walls of the plastic jacket of the strand. Since these walls are not overly strong and are not designed to oppose extreme pressures it will not under such circumstances require too long a length of strand to build up a head of liquid sufficient to balloon and ultimately rupture the plastic jacket. It has been discovered, however, that such rupture can be effectively avoided if the head of corrosion inhibiting liquid can be reduced quickly before ballooning or rupture of the strand jacket takes place. This may be done by use of the strand assembly of the present invention in which there is combined with the flexible pumping strand a preset pressure relief valve which will open and relieve the internal pressure in the strand caused by the head of liquid in the strand. Such an arrangement is shown in FIG. 1 and in more detail in cross section in FIG. 2.

Figure 2:
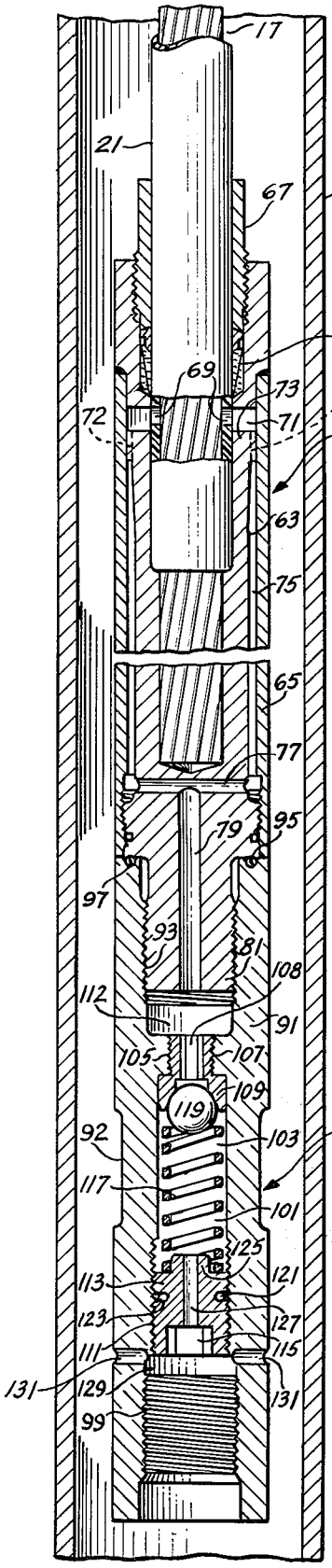
FIG. 2 is an enlarged cross sectional view of the lower portion of the flexible pumping strand assembly according to the present invention particularly illustrating the preset pressure exhaust valve component of the assembly.

In FIG. 2 there is shown a portion of the well tubing 14 and the flexible pumping strand 17 having a plastic jacket 21. The end of the flexible pumping strand 17 is secured in a compression fitting 35 which is comprised of an inner compression portion 63 and an outer shroud or sleeve 65. A packing gland 67 with packing 67*a* seals the upper end of the sleeve 65 with the surface of the strand. Orifices or holes 69 in the jacket 21 provide access from the interior of the strand to a chamber 71 in the fitting which connects through orifices 72 shown in dotted lines in the upper flange portion 73 of the inner compression portion 63 of the fitting to the annular space 75 between the sleeve 65 and the compression portion of the fitting 63. This annular space 75 in turn connects to passages 77 and 79 in the lower portion of the compression fitting 35. The lower end of passage 79 opens to the surface of the fitting on the lower end of the nose 81 of the fitting.

While the compression fitting 35 with its fluid by-pass has been described in some detail because of its intimate connection in the particular embodiment of the present invention illustrated with the pressure relief valve and flexible pumping strand assembly of the instant invention, the structure and operation of the compression fitting forms no part of the present invention, but is instead the subject of the invention disclosed, described in detail and claimed in an application being filed concurrently herewith entitled "End Fitting for Flexible Pumping Strand" co-invented by H. E. Townsend, Jr. and F. Krcmar, Ser. No. 457,527, filed Apr. 3, 1974.

Threadedly engaged with the lower portion of the compression fitting 35 is a preset pressure exhaust valve 37. Pressure exhaust valve 37 is comprised of a main body section 91 having a female threaded internal surface 93 which engages with the externally threaded nose 81 of the compression fitting 35. A further sealing effect in addition to the sealing provided by the threaded connection is effected between the exhaust valve 37 and the compression fitting 35 by means of a suitable packing ring 95 accommodated in an annular depression 97 in the upper end of the exhaust valve 37. Wrench flats 92 are preferably provided on the surface of the body 91 of the valve 37 to facilitate attachment to and removal of the valve 37 from the compression fitting 35. A second internally threaded female orifice 99 at the lower end of the exhaust valve accommodates the upper threaded end of either the shear release fitting 41 or the pony rod 39 which are shown in FIG. 1, but are omitted from FIG. 2 for clarity. The pony rod 39 is connected to and serves to operate the pump at the bottom of the well.

Within the body 91 of the exhaust valve 37 there is a chamber 101 having a straight sided central section 103, an upper reduced diameter threaded section 105 in which there is secured an upper threaded portion 107 of a ball valve seat 109, and a lower internally threaded section 111 in which there is accommodated a threaded pressure adjustment fitting 113 which is adapted to be rotatably adjusted longitudinally in the fitting by the use of a suitable wrench which may be fitted in a hexagonal wrench accommodating orifice 115 in the lower end of the fitting 113 when the pony rod 39 is unscrewed and removed as shown in FIG. 2. The upper threaded portion 107 of the ball valve seat has a square of other angularly shaped orifice or passage 108 which may be engaged by a wrench to screw the valve seat into place and also serves as a passageway from the chamber 112 under the nose 81 of the fitting 35 to the interior of the pressure release valve 37. Between the adjustment fitting 113 and the ball valve seat 109 there is accommodated a coil type compression spring 117 which serves to force a movable ball valve 119 against the seat 109 with a force which is determined by the strength of the spring and compression of the spring as determined or adjusted by the prior adjustment of the adjustment fitting 113 in the valve body. Preferably the adjustment fitting 113 will be provided with nylon or similar locking elements 121 accommodated in small depressions 123 in the side of the fitting to frictionally engage with the threads on the side of the exhaust valve to prevent unintended movement of the fitting 113 due to shocks and the like. A nose 125 of the adjustment fitting 113 fits into the bottom of the spring 117. A fluid conducting passage 127 extends through the adjustment fitting 113 from the surface of the nose 125 to the wrench accommodating orifice 115 which opens into a chamber 129 above the threaded orifice 99 which during operation accommodates the pony rod 39 or the shear release fitting 41 depending upon the particular arrangement. Orifices 131 lead from the chamber 129 to the exterior of the pressure releasing valve 37 to exhaust corrosion inhibiting fluid from the interior to the exterior of the valve.

The operation of the flexible pumping strand assembly of the invention is as follows. Upon initiation of operation of the strand in a well the strand 17 is preferably already filled with a corrosion inhibiting fluid. Additional fluid is pumped or forced into the upper portion of the strand from the reservoir 45 by the action of the pump 49 or any other suitable type of pressurization device as necessary during operation of the strand to keep the strand filled. The adjustment fitting 113 will have been previously adjusted while the end of the strand is accessible on the surface so that the ball is forced against the valve seat 109 by the action of the coil spring 117 with a predetermined pressure which is sufficient to maintain the desired pressure of corrosion inhibitor in the flexible pumping strand. Usually corrosion inhibitor in the strand will be first pumped or pressurized to an initially higher pressure than desired for normal operation. This will cause the ball valve to open to discharge the corrosion inhibiting liquid from the interior of the strand to the exterior at a fairly rapid rate and serves to ascertain or make absolutely certain that the valve will open at the correct predetermined pressure and that all orifices in the valve and the compression fitting at the end of the strand are clear. This can be determined by the fact that the internal pressure in the strand will climb until the opening pressure is reached and will then become steady as the valve opens and the excess corrosion inhibitor is discharged from the strand. After testing the valve with a higher pressure the pumping strand may then either be operated with a slight excess pressure so that the valve remains slightly open at all times or may be operated at normally lower pressures with periodic or intermittent higher pressure periods when the valve is opened to exhaust excess corrosion inhibitor to the environment and renew the corrosion inhibitor in the interstices of the pumping strand 17. For example, the pressure may be maintained at a constant level without continuous pumping and then at periodic intervals, either initiated by a timer or by an inspector during periodic inspection trips to the well head, the pressure of the corrosion inhibiting liquid within the flexible pumping strand may be increased to effect opening of the exhaust valve to make certain the valve is in operating condition and to partially flush the strand. The pressure may be increased by pumping or the like to open the preset pressure valve and allow a flow of corrosion inhibitor through the pumping strand and out into the well. This flow of corrosion inhibitor serves to flush the strand, sometimes completely, but usually only partially, and fill the strand with fresh corrosion inhibitor. The intervals between pumping or excess pressurization to open the ball valve may range from an hour or tow, or even less, up to weeks or months depending upon the corrosive conditions in the well. Usually the invervals of intermittent pumping or pressurization will be about every one or two days during regular inspection of the well. Whether pumping or excess pressurization of the corrosion inhibitor to cause its passage through the flexible pumping strand is continuous or intermittent, the corrosion inhibitor will pass into and down the strand within the plastic jacket in the interstices between the wires and will then pass from the strand through orifices 69 in the jacket 21 into the chamber 71 of the compression fitting 35 from which the corrosion inhibitor enters the annular passageway 75 between the sleeve 65 and the compression portion of the fitting. The corrosion inhibitor then passes into the orifices 77 and 79 in the lower portion of the compression fitting 35 and is transferred into the preset pressure release valve 37 where it passes through the orifice 108 in the threaded portion 107 of the ball valve seat 109 and thence past the ball valve 119 into the central section 103 of chamber 101 in the exhaust, or pressure release valve, through the passageway 127 in the adjustment fitting 113 into the chamber 129 in the exhaust, or pressure release valve and thence through the orifices 131 into the exterior environment in the bottom of the oil well. In some cases in fairly mild environments the corrosion inhibiting fluid in the pumping strand may be initially merely pressurized against the resistance of the ball valve and operated in this manner for long periods without even intermittent opening of the valve or flushing. This static condition may be continued until there is some reason to suspect that corrosion may be taking place or may be about to take place in the interior of the strand due to a change in conditions in the well or to the lapse of time with the corrosive conditions normally expected in the particular well to result in degradation or partial exhaustion of the corrosion inhibiting characteristics of the inhibiting fluid.

In any event, whenever for some reason the normal external pressure surrounding the strand should be lost due to the replacement of the normal surrounding medium with another medium such as a gas for any of a number of reasons such as infiltration of gas from the surrounding strata, failure of the down-hole pump, leakage from the well tubing due to perforation or accidental uncoupling or for any other reason, the pressure of the head of liquid within the flexible pumping strand will no longer be substantially balanced by the external pressure surrounding the strand. To forestall ballooning or rupture of the strand jacket under such circumstances the force of the spring 117 as determined by the spring characteristics and the adjustment of the adjustment fitting 113 is predetermined or preadjusted to be such that at a pressure differential which is less than the ballooning or rupture strength of the plastic jacket at any point the ball valve will be opened sufficiently to quickly relieve the internal pressure in the strand by quickly "dumping" the excess fluid from within the strand into the bottom of the oil well. The greater the pressure differential, of course, the more the ball valve will tend to open until said valve in itself presents no substantial restriction to the exhaustion of the corrosion inhibiting fluid from the pumping strand. It is important in case the pressure differential occurs suddenly that the pressure be relieved quickly and it is necessary, therefore, that the openings and orifices in the exhaust valve and in the connecting compression fitting be large enough to relieve the pressure from the strand quickly before ballooning of the plastic jacket occurs.

It will be evident that the exhaust valve, which is a critical component of the flexible pumping strand assembly of the invention, need not be connected to the strand through the compression fitting as shown, but could instead be directly connected to the end of the strand or to the plastic jacket of the strand at a location above the end of the strand. The exhaust valve arrangement shown is, however, the presently preferred arrangement. It will also be evident that the valve itself could have any one of a number of structures or mechanical arrangements designed to relieve the internal pressure in the strand when a potentially damaging pressure differential between the internal pressure in the strand and the external pressure occurs. The particular exhaust valve illustrated and described has been found, however, to be very effective and convenient and is the presently preferred arrangement for the valve.

It will be evident from the above and from the disclosure and discussion of U.S. Pat. No. 3,637,341 that the opening pressure of the valve 37 may be adjusted to many different opening pressures depending upon the characteristics of the jacket material, the depth of the well and the characteristics of the corrosion inhibiting liquid and the surrounding environment in the well.

The use of a pressure release valve in accordance with the present invention is required whenever the pressure differential between the inhibitor fluid within the strand at any depth and the pressure external of the strand at the same depth might exceed the rupture or ballooning strength of the thickness of the particular plastic from which the jacket of the particular strand is composed. Such rupture or ballooning is most likely to occur, of course, as has been explained above, when a loss of fluid, and usually a sudden loss of fluid, is experienced from the interior of the well tubing through which the flexible pumping strand passes. It will be understood that rupture of the strand jacket usually will only take place after ballooning has already occurred. However, since ballooning of the walls of the jacket of the strand inevitably decreases the thickness and thus the strength of the jacket, once ballooning has begun the ballooning out of the walls of the jacket will rapidly increase, usually at an increasing rate, until actual rupture of the plastic jacket occurs. Usually the only reason that a ballooned jacket will not quickly proceed to complete rupture will be either because the excess pressure within the jacket is very quickly removed or the material from which the jacket is formed has the property of increasing in strength as it is stretched, such as may happen with many metals due to work hardening or with some compositions of resinous materials due to molecular orientation when the ultimate pressure is not too great. Thus with some plastic materials from which the jacket of the strand may be formed the rupture strength may be somewhat greater than the ballooning strength of the plastic, while with other plastics the ballooning and rupture strength, or conversely the ballooning and rupture pressure, may be substantially the same. Furthermore, as has previously been pointed out some plastics will experience rupture without initial ballooning and other plastics will experience rupture without ballooning when exposed to certain environments or conditions. In any event, as has been explained previously, because ballooning is usually detrimental in itself since it may result in ensuing mechanical damage to the strand, and also because it is usually desired to include a very substantial safety factor when deciding what pressure should be allowed to build up in the strand, either the ballooning or rupture pressure of the plastic jacket will usually be selected as the pressure from which to calculate the pressure at which the pressure exhaust valve according to the present invention should be set to open depending upon whether ballooning or rupture will occur first with the particular type plastic from which the strand jacket is constructed. It will be understood that the resistance of the plastic strand jacket to transverse forces such as internal strand pressure will be dependent primarily upon the material from which the jacket is formed, the thickness of the jacket and the diameter or radius of the jacket as well as upon some subsidiary considerations such as temperature and surface condition of the plastic.

The differential pressure $P$ exerted upon the strand jacket containing an inhibitor fluid having a density $d_1$ at a depth $D$ in a well having an environment with a fluid density $d_2$ can be calculated approximately (neglecting in particular dynamic effects) from the general formula:

$$P = gD\,(d_1 - d_2) - P_T$$

where $g$ is the local gravitational constant (customarily taken as 0.433 when $D$ is given in feet, $d_1$ and $d_2$ are given in gms/cu. cm., and $P$ is given in pounds per square inch) and $P_T$ is the pressure within the well tubing at the top of the well. In the event that the liquid in the tubing is displaced by gas or vapor, the pressure acting to balloon or rupture the strand jacket can then attain at the lowest point from which the liquid in the tubing is completely displaced a value expressed approximately by the following equation:

$$P = gD\,d_1$$

In general, therefore, it is desirable that the pressure at which the pressure exhaust valve will open be adjusted or preset to a value given by the equation:

$$P_V = \frac{P_S}{f}$$

where $P_V$ is the pressure at which the exhaust valve is set to open, $P_S$ is the rupture or ballooning strength of the strand jacket and $f$ is any desired factor of safety. A satisfactory useful factor of safety will usually be a factor of 3 or more. A static system, i.e., a system in which the valve is not open, will result when the value of the exhaust valve setting is greater than the value given by:

$$P_V = gD\,(d_1 - d_2) - P_T$$

or $$P_V > gD\,(d_1 - d_2) - P_T$$

A continuous flow of inhibitor fluid through or past the exhaust valve can be effected by providing an exhaust valve setting less then the above or by applying additional pressure at the well head to the inhibitor liquid within the interior of the pumping strand.

It will be understood that certain dynamic considerations will also effect the pressure of the corrosion inhibitor fluid in the strand and the pressure of the well fluid within the tubing. For example, there is a certain impulse factor in the pressure within the strand due the impact loading of the reciprocating strand as it changes direction at each end of its pumping stroke. These dynamic considerations can usually be ignored if a reasonable safety factor is used in presetting the pressure at which the exhaust valve is set to open.

The rupture pressure or strength of the strand jacket can be approximated from the relation:

$$P_S = \frac{T\,S_D}{R}$$

where $T$ is the jacket thickness, $R$ is the strand radius and $S_D$ is the yield strength (in force per unit area) of the material from which the jacket of the strand is formed.

In one typical example of the invention a 5200-foot-deep well containing a well fluid having a specific gravity of 0.9 and in which the well fluid is pumped to the surface with a flexible pumping strand containing a corrosion inhibiting liquid having a specific gravity of 1.0, the strand may be provided with a 0.1-inch-thick polyamide resin type jacket, which jacket will typically have a ballooning or rupture pressure of approximately 1300 pounds per square inch. The flexible pumping strand may be reciprocated by a suitable prime mover at the surface in order to operate a pump positioned at the bottom of the well, which pump serves to force well fluid up the well through the well tubing with a tubing pressure of 50 pounds per square inch. The absolute fluid pressure within the interior of the flexible pumping strand near the bottom due to the head of inhibitor fluid contained in the strand will be approximately 2252 (the pressure exerted by the superimposed atmospheric pressure is for simplicity not included). The differential pressure between the inhibitor fluid in the interior of the strand and the well fluid exterior of the strand will be approximately 176 pounds per square inch when the pump is operating and approximately 226 pounds per square inch when the pump is not operating and the pressure in the well fluid in the tubing is thus reduced by the 50 pounds per square inch operating pressure. It will be understood that the actual pressure in the well fluid in the tubing will be an oscillating pressure due to the oscillating motion of the well pump. The pressure in the well fluid does not return to the pure head pressure of the liquid in the tubing on the downstroke of the pump, however, due to back pressure in the pumping system and it is convenient, therefore, to consider that there is a single or constant operating pressure in the well tubing during operation of the pump. This operating pressure is normally measured at the well head and it will be also understood that the operating pressure at the well head due to the operation of the pumps tends to be somewhat less at the well head than near the pump at the bottom of the well due to friction losses in the well tubing. These variations in pressure can, however, normally be ignored if a reasonable safety factor is allowed for in the calculations.

It will be evident that in the event that the well tubing should become emptied completely of fluid the differential pressure between the interior and exterior of the strand would become, near the bottom of the strand, substantially the same as the head of corrosion inhibitor liquid within the strand, or 2252 pounds per square inch. A pressure exhaust valve preset to open upon the attainment of a pressure differential between the interior and the exterior of the strand of less than the 1300 pounds per square inch is thus required for safety to prevent ballooning or rupture of the strand jacket in the event of sudden loss of well fluid from the well or well tubing. As it is generally desirable to provide a factor of safety of about 3 or more with respect to rupture strength of the plastic jacket in determining the opening pressure of the exhaust valve, in the well of the example the exhaust valve is preset to open at a differential pressure of approximately 433 pounds per square inch. Since the normal operating pressure differential between the interior and the exterior pressure of the strand in the illustration is 176 pounds per square inch, the valve is maintained normally closed and the corrosion inhibiting fluid does not flow past the exhaust valve except when additional pressure is applied to the fluid within the strand interior from a pressurizing system at the top of the well. Such additional pressure will normally be applied initially to make certain that the valve will in fact open at approximately the correct pressure and also to flush the end of the strand. The initially high pressure will then be returned to normal operating limits. Additional pressure will thereafter also be applied periodically at spaced intervals varying from several hours to several weeks to open the exhaust valve and partially renew or flush the corrosion inhibiting fluid from the interior of the flexible pumping strand. Alternatively, a continuous flow of corrosion inhibiting fluid could be maintained through the strand and the exhaust valve by presetting the exhaust to open at a pressure less than 176 pounds per square inch. In such a case the higher the pressure the wider the exhaust will open and the greater the flow of corrosion inhibitor through the pumping strand which will be attained. As a still further alternative the preset opening pressure of the exhaust valve can remain at 433 pounds per square inch and the normal operating pressure of the fluid within the strand can be increased above 433 pounds on a continuous basis. Since oil wells are customarily operated, or pumped, unattended, however, and inspected and worked on only periodically and since operation at a pressure of more than 433 pounds per square inch differential pressure will reduce the normally desirable safety factor of about 3 or greater, or in other words operate the well at a pressure nearer to the rupture or ballooning pressure of the plastic strand jacket, it will normally be desirable to reduce the preset opening pressure of the exhaust valve rather than increasing the internal pressure of the fluid within the strand if a continuous or substantially continuous flow of corrosion inhibiting liquid through the strand is desired.

It should be noted that owing to the flexibility of the strand jacket the internal volume of the jacketed strand, and hence the resistance to hydraulic flow through the strand, is pressure dependent. As a result of this pressure dependence a pressure applied at one end of a long length of jacketed strand will not be immediately evident at the other end. Because of this time lag phenomenon pressure applied to the interior of flexible pumping strand at the well head by pressurization apparatus such as the pump 49 or other suitable apparatus must be applied for a substantial period depending upon conditions in order to effect opening of the exhaust valve at the bottom of the strand.

In one actual experimental trial of flexible pumping strand assemblies incorporating the invention a 5201 foot length of strand was used in a well having a well fluid specific gravity of 1.02 ($d_2$) and a normal operating pressure at the top of the tubing of 40 pounds per square inch ($P_T$). A corrosion inhibiting fluid was used in the interior of the strand having a specific gravity of 0.82 ($d_1$). The strand jacket was formed from a polyamide commonly referred to as nylon 11 approximately 0.1 inches in thickness ($T$) and having a rupture pressure of 1300 pounds per square inch ($P_S$). The bottom pressure ($gDd_1$) at the bottom and the interior of the strand was 1847 pounds per square inch [.433(5201)0.82 = 1847]. The differential pressure between the interior of the strand and the exterior of the strand when the well pump was operating was −490 pounds per square inch. The differential pressure is indicated in this case to be a negative figure because the pressure in the interior of the strand was less than the pressure on the exterior of the strand - since the specific gravity of the corrosion inhibiting fluid in this example was less than the specific gravity of the well fluid. The differential pressure between the interior of the strand and the exterior of the strand was −450 pounds per square inch when the well pump was not in operation and the pressure of the pump was not being added to the normal pressure head of the well fluid in the tubing. Since there was already a fairly large working spread between the point where the internal pressure of the strand might become greater than the exterior pressure surrounding the strand, it was possible in this example to use a large factor of safety for the setting on the exhaust valve. Thus in the experimental strand the opening pressure exerted by the valve spring was adjusted to be 160 pounds per square inch. (Since the plastic jacket on the strand is normally very effectively supported from the underside by the closely packed wires of the strand, particularly in those cases where the strand jacket has been desirably pressure extruded over the underlying wires of the strand, there is very little likelihood under normal operating conditions that the strand jacket will rupture inwardly.) With the valve set to open at 160 pounds per square inch the pressure applied to the strand at the well head which would cause the valve to open was 650 pounds per square inch (160 psi. spring pressure plus 490 psi. differential pressure.) The valve opening pressure of 160 pounds per square inch provided a safety factor of 8.13, well over the normal desirable safety factor of at least 3 in a strand such as that of the example having a rupture pressure of 1300 pounds per square inch. The strand of the example was an experimental assembly and in a similar commercial installation in which the specific gravity of the well fluid is greater than the specific gravity of the corrosion inhibitor within the strand an even larger factor of safety could be used. If, due to the complete loss of external pressure as the result of loss of well fluid from the well tubing or a portion of the tubing, the internal pressure within the strand should exceed the safety factor which has been established, the exhaust valve will open and exhaust the corrosion inhibiting liquid from the strand at a rate which will prevent excessive pressure from building up and ballooning or rupturing the strand jacket.

In a second actual example of the invention a 2200 foot length of experimental strand was used in a test well containing a well fluid with a specific gravity of 1.05. The jacket of this strand, like the first strand, was composed of the polyamide nylon 11 and had a thickness of 0.1 inches. As in the previous examples this provided a rupture strength of 1300 pounds per square inch. The tubing pressure, or operating pressure, in the well was 12 pounds per square inch. The specific gravity of the corrosion inhibiting liquid within the strand had, as in the first example, a specific gravity of 0.82. The absolute pressure at the bottom of the interior of the strand was 781 pounds per square inch. It will be noted that this pressure would normally be insufficient to rupture the strand jacket even if all the external supporting pressure was lost as the result of drainage of the well fluid from the tubing of the well. However, it is still desirable in such a case to provide an exhaust valve in the strand in order to assure a reasonable safety factor in the event of malfunction of the corrosion inhibiting liquid pumping system and possible overpressurization of the strand. For example, if all the well fluid should drain from the strand of the example and the corrosion inhibiting fluid pressurization or pumping system should apply a pressure of slightly more than 500 additional pounds per square inch pressure to the interior of the strand the strand jacket would rupture. It is thus advantageous to provide a healthy margin of safety below this pressure and in the example the exhaust valve was set to open at a pressure of 330 pounds per square inch. The factor of safety in this example was, therefore, 3.94. This figure was the factor by which the rupture strength of the strand was greater than the setting of the exhaust valve. Since the pressure differential was −231 pounds per square inch when the pump was operating and −219 pounds per square inch when the pump was not operating, the pressure which would have to be applied to the corrosion inhibiting liquid at the well head to cause the exhaust valve to open was 561 pounds per square inch during operation of the pump.

It should be noted that the use of a preset exhaust valve as part of a flexible pumping strand assembly is desirable not only to avoid rupture of the strand during operation of the well in the event that external pressure is suddenly lost from the exterior of the strand due to loss of well fluid from the well tubing or the like, but also when the strand is being installed in a well. The strand is normally installed within the well already charged with a corrosion inhibiting liquid. The strand is precharged with liquid because otherwise when the strand first contacts the well fluid some of the external well fluid might otherwise gain entrance to the interior of the strand and also because due to the constricted nature of the interior of the strand it is very difficult to displace any air in strand with the corrosion inhibiting fluid once the strand is installed in a well. Considerable external pressure is in such case required to force the corrosion inhibiting liquid into the strand to displace the air and there is an actual danger that the applied pressure may be great enough to balloon or rupture the plastic jacket near the top of the strand — rather than near the bottom — during charging. For this reason it is very desirable that the strand be installed already charged with corrosion inhibiting liquid. When the strand is run into the well already charged, however, since the well has not been operating, the well tubing will not be filled with well fluid, at least in its upper portions, and the strand will thus hang down the well for a finite period without substantial external support. In a deep well, therefore, it is necessary that the internal pressure be removed from the strand to avoid rupture of the strand in its lower sections. Removal of any excess pressure during installation of the strand is accomplished by the exhaust valve opening at the preset pressure so that the corrosion inhibitor flows freely from the strand into the well. As long as the valve is opened sufficiently to allow the corrosion inhibiting liquid to flow freely through the strand at its maximum rate, which rate is, however, restricted by the frictional flow resistance engendered in the constricted cross section of the strand along the length of the strand, no excess pressure will build up in the strand and the strand jacket will not rupture. It is, of course, advantageous to replace new corrosion inhibiting liquid at the top of the strand during installation of the strand in the well as the inhibitor liquid trickles from the bottom of the strand into the well through the exhaust valve. However, if the installation crew works quickly the strand can usually be installed and in operation within a few hours in which time only a small proportion of the inhibitor fluid may be lost from the strand, for example perhaps 10% or thereabouts of the total inhibitor in the strand, which amount can in practice be replaced without too much difficulty once operation of the strand commences. To avoid ballooning or rupture of the strand jacket during installation of a long strand in a well, therefore, it is usually necessary to have the exhaust valve open to exhaust the inhibitor fluid from the interior of the strand at the bottom into the well at the maximum flow-through rate of the inhibitor through the strand interstices. This rate is sufficient to remove all significant internal pressure from the strand, but not usually great enough in a long strand to seriously empty the strand if installation is made quickly and expeditiously. If new corrosion inhibitor is, as is desirable, added continuously to the top of the strand, of course, the installation of the strand in the well can take as much time as may be necessary.

The exhaust valve of the invention is normally designed by initially deciding what the size of the opening 108 through the valve seat in cooperation with the size of the opening through the passage 127 in adjustment fitting 113 must be in order to quickly release or dump the corrosion inhibiting fluid from the strand in the event of a build-up of internal pressure due to a sudden loss of external well tubing pressure. A spring having a strength and spring constant sufficient to oppose the pressure developed against the ball valve 119 by a fluid pressure exerted over this area is then selected to oppose opening of the ball valve. Knowing the pressure and the spring constant, the required compression of the spring to oppose any pressure can be readily calculated. As a practical matter the exhaust valves are usually precalibrated in the shop by initially threading the adjustment fitting 113 all the way into the valve until the spring 117 is completely compressed, applying an external pressure to the valve through the opening 108 and backing the adjustment fitting out while varying the applied pressure to determine the number of turns of the fitting 113 for any given opening pressure. A calibration curve can easily be prepared having the opening pressure on one coordinate and the number of turns of the adjustment fitting on the other coordinate and the curve used in the field to determine the opening pressure of the valve for any given number of turns of the adjustment fitting. The fitting may be easily turned or adjusted by means of a conventional hexagonal or other suitably shaped wrench inserted into the wrench accommodating orifice 115. The nylon or other locking elements 121 which frictionally engage with the threads on the side of the exhaust valve body prevent unintended movement of the adjustment fitting after it is adjusted to maintain a predetermined pressure.

It will be understood that the above general analysis of the factors to be considered in determining the opening of the pressure exhaust valve at the lower end of the linear pumping assembly of the invention should be recognized as a practical approximation based upon a hydrostatic analysis and that certain hydrodynamic effects, some of which are noted at places throughout the foregoing specifications, would also have an effect upon an operating system.

We claim:

1. A corrosion and mechanical damage resistant flexible pumping strand assembly arranged and constructed to extend downwardly through oil well tubing positioned in an oil well and to connect at the lower end thereof to pumping means for pumping well fluid, which fluid includes corrosive substances, upwardly through said tubing, comprising:

a. a flexible wire strand comprising a plurality of wires with interstices between the wires, b. a flexible plastic jacket disposed about at least that portion of said wire strand exposed to said well fluid and arranged and constructed to contain within the strand in the interstices between the wires of said strand a liquid that:

i. is corrosion inhibiting with respect to corrosive substances in said well fluid, and ii. has a specific gravity similar to that of said well fluid such that the pressure differential between the corrosion inhibiting liquid within the plastic jacket and the well fluid on the outside of the plastic jacket when the strand is placed in said well is less than the rupture strength of said jacket, and c. pressure relief valve means connected to said wire strand and said plastic jacket adjacent the lower ends thereof and arranged and constructed to open when the pressure of said corrosion inhibiting liquid contained within the plastic jacket in said interstices between the wires of the strand exceeds by a predetermined degree the pressure of said well fluid external of said plastic jacket, said predetermined degree defining a predetermined pressure differential adjacent said pressure relief valve means which is less than the pressure differential which will cause rupture of said plastic jacket.

2. A mechanical and chemical damage resisting linear rod assembly for use in a well containing corrosive well-environment fluids and for operative mechanical connection of a down-hole pumping means to a prime mover means comprising:

a. an elongated linear member comprising a flexible wire strand having a flexible plastic jacket disposed circumferentially thereabout throughout the length thereof, b. a corrosion inhibiting liquid contained within said jacket and bathing the wires of said strand and having a specific gravity substantially similar to the specific gravity of the surrounding well-environment fluids such that the pressure differential between the inside and outside of said plastic jacket is less than the ballooning strength of said jacket, c. a pressure-releasing valve means positioned near the lower pumping means connection end of said linear member to provide access from the interior to the exterior of said linear member, d. said pressure-releasing valve means being arranged and constructed to open when the internal pressure of the corrosion inhibiting liquid within the linear member is a predetermined degree higher than the pressure of the well-environment fluids external of said pressure-releasing valve means, said predetermined degree defining a pressure differential which is less than the rupturing pressure of the plastic jacket of the linear member.

3. A linear assembly according to claim 2 wherein the pressure-releasing valve means is a spring activated pressure relief valve.

4. A linear rod assembly according to claim 3 wherein said pressure-releasing valve means is secured to the lower end of said linear member.

5. A linear rod assembly according to claim 4 wherein said pressure-releasing valve means is attached to said linear member via an intermediate end fitting secured to said linear member.

6. A mechanical and chemical damage resisting linear rod assembly for use in a well containing corrosive well-environment fluids and for operative mechanical connection of a down-hole pumping means to a prime mover means comprising:

a. an elongated linear member comprising a flexible wire strand, b. a flexible plastic jacket disposed about at least the portion of said flexible wire strand which it to be exposed to said corrosive well-environment fluids, c. a corrosion inhibiting liquid contained within said flexible plastic jacket and bathing the component wires of said flexible wire strand, said corrosion inhibiting liquid being selected to have a specific gravity similar to the specific gravity of surrounding well-environment fluids such that the pressure differential between the inside and outside of said plastic jacket when the strand is placed in said well is less than the rupture strength of said jacket, d. an internal pressure-releasing valve means positioned adjacent the lower end of said wire strand near the bottom of said well, said pressure-releasing valve means being arranged and constructed to be secured to a pumping means connection and providing restricted access from the interior to the exterior of said flexible plastic jacket, e. said pressure-releasing valve means being arranged and constructed to open when the internal hydrostatic pressure of the corrosion inhibiting liquid within the wire strand component of the linear member is a predetermined degree higher than the pressure of the well-environment fluids external of said pressure-releasing valve means, said predetermined degree defining a pressure differential which is less than the rupturing pressure of the plastic jacket disposed about the flexible wire strand.

* * * * *

UNITED STATES PATENT AND TRADEMARK OFFICE

CERTIFICATE OF CORRECTION

PATENT NO. : 3,945,795

DATED : March 23, 1976

INVENTOR(S) : Herbert E. Townsend and James B. Horton

It is certified that error appears in the above-identified patent and that said Letters Patent are hereby corrected as shown below:

Col. 1, line 23, "to" should read--the--.

Col. 1, line 30, "including" should read --inducing--.

Col. 4, line 15, "feed " should read --feet--.

Col. 6, line 29, "of" should read --or--.

Col. 7, line 42, "tow" should read --two--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*